US005204700A

United States Patent [19]

Sansalone

[11] Patent Number: 5,204,700

[45] Date of Patent: Apr. 20, 1993

[54] DIVING MASK HAVING DISTORTIONLESS PERIPHERAL VISION

[76] Inventor: Salvatore N. Sansalone, 12 Paradise Gardens, Bramalea, Ontario, Canada, L6S 5C7

[21] Appl. No.: 606,457

[22] Filed: Oct. 31, 1990

Related U.S. Application Data

[63] Continuation-in-part of Ser. No. 276,470, Nov. 25, 1988, abandoned.

[51] Int. Cl.[5] ..... G02C 1/00

[52] U.S. Cl. ..... 351/43; 351/41

[58] Field of Search ..... 351/41, 43; 2/428–441; 359/708, 712

[56] References Cited

U.S. PATENT DOCUMENTS

| | | | |
|---|---|---|---|
| 1,742,412 | 1/1930 | O'Flanagan . | |
| 2,008,530 | 1/1935 | Wick . | |
| 2,088,262 | 1/1937 | Grano . | |
| 2,617,100 | 1/1952 | Moeller . | |
| 2,730,014 | 1/1956 | Ivanoff et al. . | |
| 2,876,766 | 3/1959 | Rebikoff et al. . | |
| 2,928,097 | 9/1960 | Neufeld . | |
| 2,952,853 | 9/1960 | Benzel . | |
| 3,010,108 | 11/1961 | Sachs . | |
| 3,027,562 | 4/1962 | Widenor . | |
| 3,040,616 | 6/1962 | Simpson . | |
| 3,051,957 | 9/1962 | Chan . | |
| 3,055,256 | 9/1962 | Andresen | 351/43 |
| 3,320,018 | 5/1967 | Pepke . | |
| 3,483,569 | 12/1969 | Armendariz . | |
| 3,672,750 | 6/1972 | Hagen | 351/43 |
| 3,899,244 | 8/1975 | Mulder . | |
| 3,976,364 | 9/1976 | Lindemann et al. . | |
| 4,256,386 | 3/1981 | Herbert . | |
| 4,373,788 | 2/1983 | Herbert . | |

FOREIGN PATENT DOCUMENTS

| | | |
|---|---|---|
| 861753 | 4/1953 | Fed. Rep. of Germany . |
| 1277106 | 12/1960 | France . |
| 1374010 | 12/1964 | France . |
| 558249 | 5/1977 | U.S.S.R. . |

OTHER PUBLICATIONS

Gregg, 52 Optometric Weekly 1381–1385, 1388 (Jul. 1961).

*Primary Examiner*—Rodney B. Bovernick

*Attorney, Agent, or Firm*—Shlesinger, Arkwright & Garvey

[57] ABSTRACT

A diving mask comprising a supporting member for sealing engagement with the face of the user, a lens mounted in the supporting member near the eyes of the user to provide a low volume mask, a major portion of the lens being curved so that apparent magnification of images underwater is less than that observed through a conventional flat lens plate, certain portions of the lens being further curved to eliminate or mitigate pincushion-type distortion.

27 Claims, 4 Drawing Sheets

DIVING MASK HAVING DISTORTIONLESS PERIPHERAL VISION

This invention is a diving mask having a lens which permits virtually the same distortionless and widely peripheral vision in air to the diver in water, and is a continuation-in-part of U.S. patent application Ser. No. 07/276,470, filed Nov. 25, 1988 now abandoned.

BACKGROUND OF THE INVENTION

Prior art attempts to make diving masks are best represented in U.S. Pat. Nos. 3,055,256 issued Sep. 25, 1962 to John H. Andresen, Jr., U.S. Pat. No. 3,672,750 issued Jun. 27, 1972 to Kenneth G. Hagen and U.S. Pat. No. 3,320,018 issued May 16, 1967 to Max H. Pepke. The Andresen '256 patent discloses a mask for divers with imperfect vision which includes a conventional mask frame in which is mounted a spherical lens. The Hagen '750 patent discloses a diving mask with curved lenses for each eye, with a center of curvature for each lens at the eyeball of the user. The Hagen mask should be custom made for each user to locate the specific eye points (e.g. optical centers and eye depth) properly; a universally acceptable mask simply cannot be made according to the teachings of Hagen. Further, it has been found that only slight shifting of the Hagen mask on the user's face distorts one's vision to such an extent that nausea may result. Obviously then, such a diving mask is fundamentally unacceptable.

Pepke '018 is relevant at FIG. 20, showing a diving mask, again with spherical lenses having separate centers of curvature but located at the pupils of the eyes of the user, rather than at the centers of the eyeballs. The Pepke mask suffers the same deficiencies as Hagen's; the teachings of the Pepke patent cannot be used to produce a universally acceptable, distortionless vision mask but only individual masks, custom made for each category of diver user.

Remaining prior art disclosures are remote. U.S. Pat. No. 2,876,766 issued Mar. 10, 1959 to Dimitri Rebikoff et al and U.S. Pat. No. 3,010,108 issued Nov. 28, 1961 to Melvin H. Sachs illustrate diving mask lenses curved laterally and vertically. However, neither patent even remotely suggests a mask lens curvature specifically designed and configured to provide distortionless vision underwater. The distortions inherent in such unspecified curvatures have also been found to dangerously cause nausea to users. U.S. Pat. No. 2,952,853 issued Sep. 20, 1960 to Howard a Benzel and U.S. Pat. No. 3,027,562 issued Apr. 3, 1962 to James K. Widenor are more remote and simply show diving masks curved in a plane only; vision distortion is only exacerbated by such a construction, not alleviated. U.S. Pat. No. 3,483,569 issued to Israel Armendariz is similar. Again, the safety-threatening condition of a diver nausea is inherent in these designs.

More exotic disclosures of attempts to provide magnification-free underwater vision are provided by U.S. Pat. Nos. 3,040,616, issued Jun. 26, 1962 to George R. Simpson and U.S. Pat. No. 4,373,788 issued Feb. 15, 1983 to M. Linton Herbert. These patents disclose dual focal point lenses structures with air chambers behind the lenses in the former patent and a filling and draining bladder structure in the latter to permit readjustment of several lenses. Clearly, both designs are unfavorably complex and impractical.

Other prior art disclosures directed to attempt to improve certain aspects of underwater vision and/or provide diving mask myopia-correction lenses include U.S. Pat. No. 2,928,097 issued Mar. 15, 1960 to Lester M. Neufeld, U.S. Pat. No. 3,051,957 issued Sep. 4, 1962 to Chester C. Chan and French Pat. No. 1,374,010 issued Aug. 24, 1964 to Jean-Louis Marro and an article entitled Visual Problems of Skin Diving by James R. Gregg, Skin Diver Magazine, April 1961, reprinted in The Optometric Weekly, Jul. 13, 1961 pp 1381–1388.

What the prior art fails to disclose is a diving mask having a lens configured to provide substantially distortion-free underwater vision, a major portion of the mask lens being curved so that the apparent magnification of images underwater is less than that observed through a conventional, flat lens plate, certain portions of the lens being further curved to eliminate or mitigate pincushion-type distortion.

OBJECTS AND SUMMARY OF THE INVENTION

Accordingly, it is a principal object of the invention to provide an enhanced peripheral vision mask or other underwater vision device having a faceplate lens major surface created from a specified aspherical, an ellipsoid or a paraboloid configuration to improve underwater vision by reducing pincushion-type or barrel-type distortion and magnification.

It is a further object of the invention to provide a low volume, enhanced peripheral vision mask created from the combination of a narrow skirt which allows a portion of the user's nose to extend forwardly of a faceplate lens major surface created from a sphere configuration.

It is another object of the invention to provide a diving mask having a faceplate lens curved in a predetermined manner so that vision underwater appears to be more closely similar to vision in air.

It is a further object of the invention to provide a diving mask having a faceplate lens of simplified, uncomplicated structure which is low in cost of manufacture yet provides substantially distortion-free underwater vision.

It is yet a further object of the invention to provide an uncomplicated and substantially distortion-free magnifying diving mask.

BRIEF DESCRIPTION OF THE DRAWINGS

These, and further objects of the invention will become readily apparent by reference to the following detailed specification and drawings in which.

DESCRIPTION OF THE PREFERRED EMBODIMENTS

Figure 1:
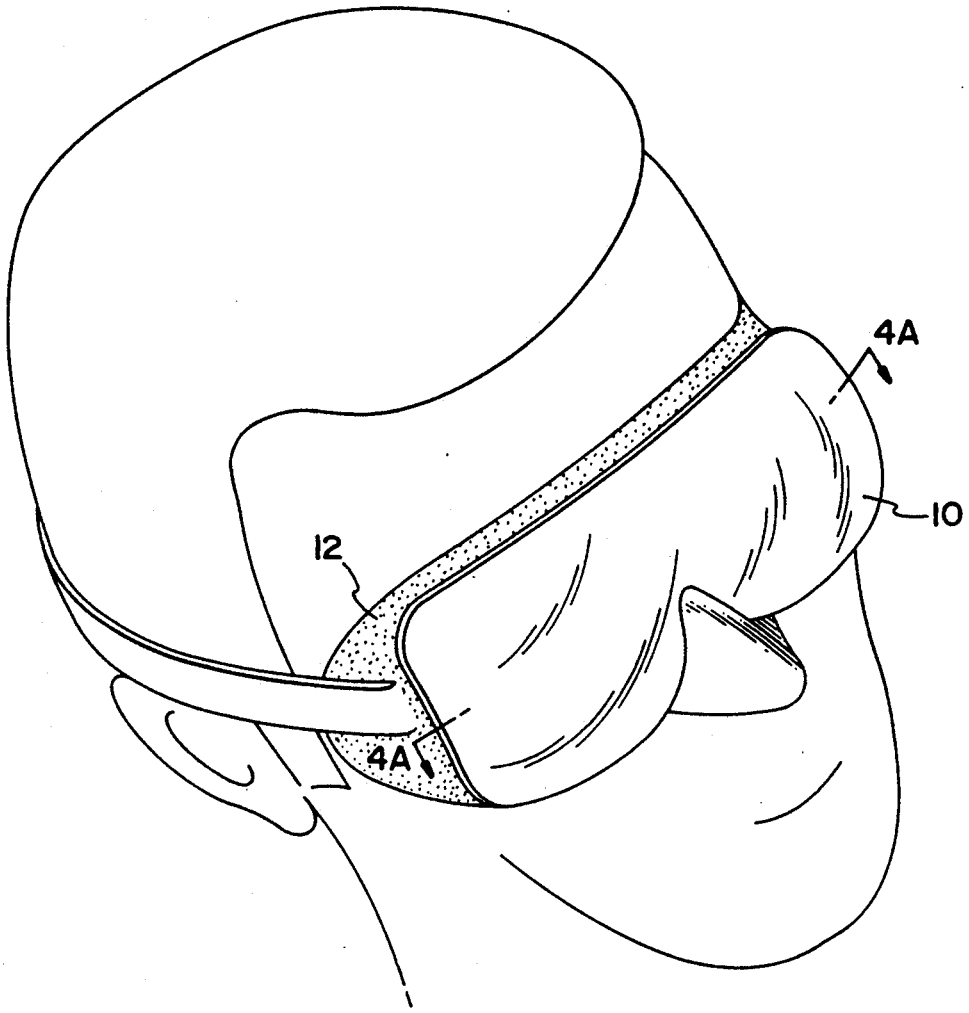
FIG. 1 is a perspective view of one embodiment of the invention being worn by a user.
Figure 2:
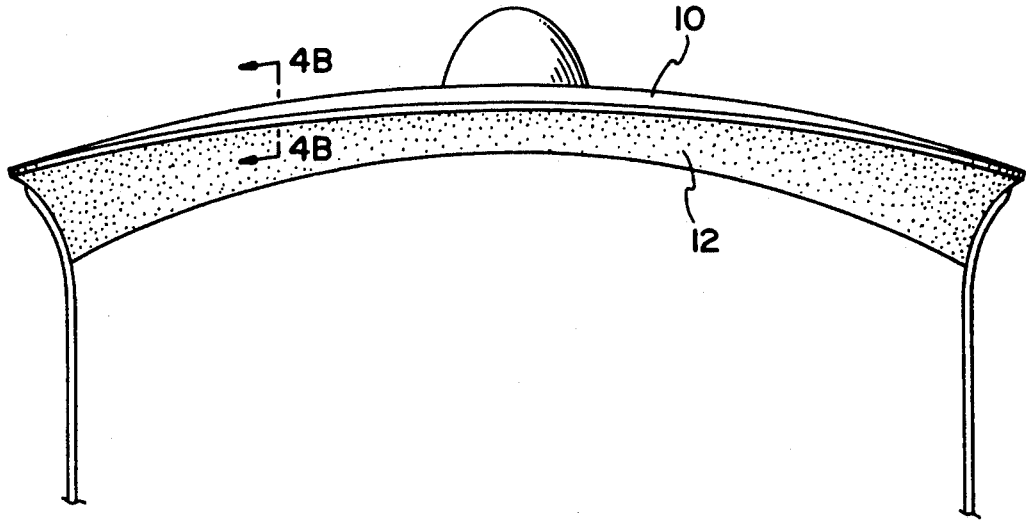
FIG. 2 is a top plan view of the diving mask shown in FIG. 1 and drawn to an enlarged scale.

Referring now to the drawings by reference character, and particularly FIGS. 1 and 2 thereof, an embodiment of the invention is shown including a simple faceplate lens 10 carried by a thin profile surrounding skirt 12. The low profile of skirt 12, with a portion of the user's nose extending forwardly of the lens, combined with curved faceplate lens 10 provides a streamlined mask of low internal volume. Also, the construction permits the lens 10 to be as close to the face and eyes of the user as comfort and practically will permit, so that peripheral vision is further enhanced in part by expected mathematical effect. In the case of simple spherical lenses, however, there is noted an additional further, unexpected, disproportionate, geometrically synergistic effect which plays an extended role of enhancing peripheral vision beyond the relevant prior art teachings.

Faceplate lens 10 may be made from material generated from any one of a wide variety of geometric shapes. Unlike prior art faceplate lenses, it has been found possible to create a lens which is virtually distortion-free and substantially devoid of pincushion-type or barrel-type distortion. Pincushion distortion occurs as the field of vision is viewed anywhere except generally straight ahead and increases as the field is viewed farther and farther from straight ahead. For example, parallel straight lines, horizontal and vertical, appear to acquire increasingly more distance between them with increasing distance from the field of view's central portion.

It has long been desired to create an acceptable diving mask wherein vision underwater appears the same as unobstructed in air, in other words, a mask having a lens that reduces the magnifying effect of water viewed through the air inside the mask and at the same time provides continuous and truly substantial peripheral vision.

Figure 3:
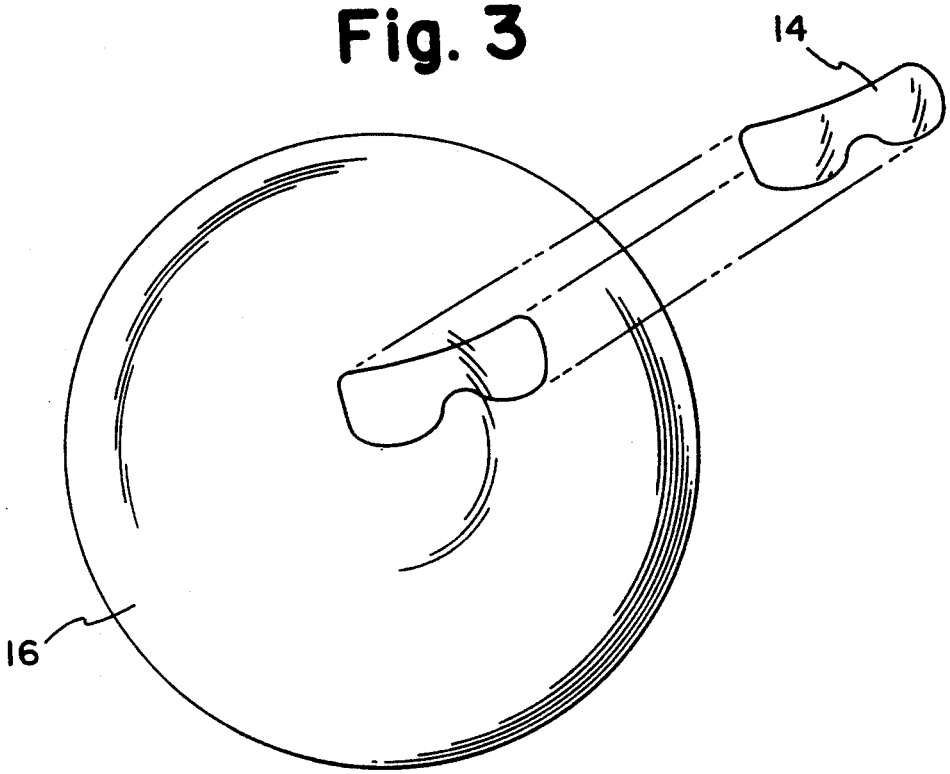
FIG. 3 is a perspective view showing the generation of a diving mask faceplate lens from a sphere.

With reference to FIG. 3, I have found that a suitable mask can be made by combining a narrow supporting skirt which positions the lens so that a portion of the user's nose extends forwardly from the lens, with a lens of transparent material created from a spherical surface. Thus, a lens 14, is shown having a single radius of curvature across the entire surface thereof, the center of curvature of the sphere being well behind the eyeballs of the user. This lens, in combination with the aforementioned new positioning is in direct contradistinction to prior art diving masks which are intended to eliminate the visual magnification present by being underwater, such masks teaching either dual curved lenses having centers of curvature at the centers of the user's eyeballs or at the user's pupils, or in another example the single curved lens failing to be combined with the peripheral-vision-enhancing positioning described above, which produces an unexpected, disproportionate and synergistic geometrical effect. In a preferred embodiment, the radius of curvature of the sphere 16 will be in a range of from five to about seventeen inches or more and, more preferably, on the order of about nine-to-twelve inches. This provides a diving mask lens wherein the user appears to see objects underwater much the same as he would in air, without the typical magnification created by the fact that the index of refraction of water is about 1.33 Whereas that of air is 1.

Figure 4A:
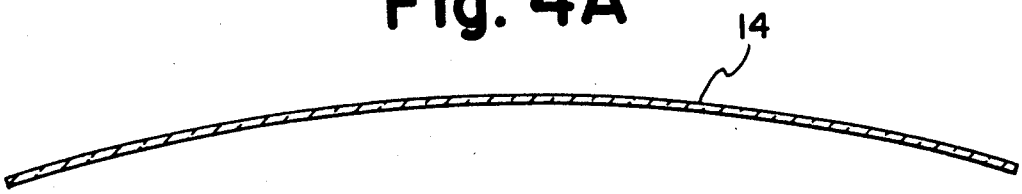
FIGS. 4A and 4B are lateral and vertical section views, respectively, taken through a lens generated from a sphere and taken along lines 4A—4A and 4B—4B of FIGS. 1 and 2 respectively.
Figure 4B:
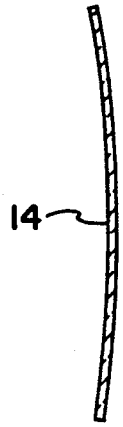

FIGS. 4A and 4B illustrate such a lens 14 in horizontal and vertical cross-section.

Figure 5A:
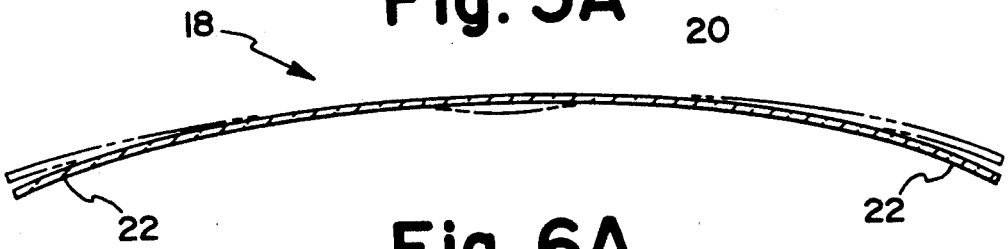
FIGS. 5A and 5B are section views similar to FIGS. 4A and 4B, showing a lens generated from an aspherical configuration such as, for example, specific-radius spherical in the center and a smaller radius/radii group towards the edge portions.
Figure 5B:
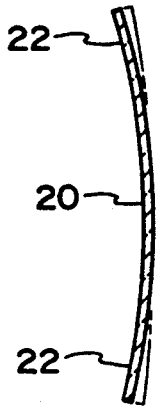

FIGS. 5A and 5B, similar to FIGS. 4A and 4B, illustrate an even more satisfactory lens surface 18 wherein, for example, a central, major portion 20 is spherical and the outer, upper and lower edges become specified aspherical or ellipsoidal in configuration as is indicated at 22. This more pronounced curvature at portions 22 assists in reducing the pincushion-type distortion phenomenon discussed above. These views also illustrate that the lens 20 could alternatively be generated as an aspherical surface of specified, incrementally decreasing radii beginning from a center axis or center point or points, the latter of which is illustrated in dotted lines in FIG. 5A.

Figure 6A:
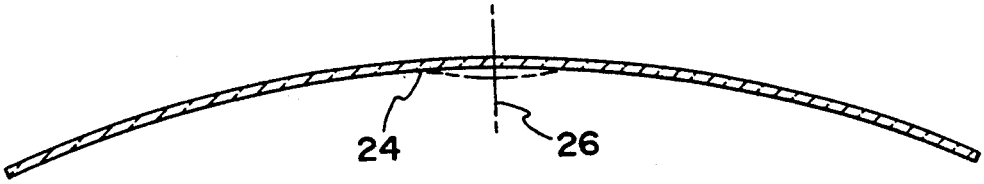
FIGS. 6A and 6B are section views similar to FIGS. 4A and 4B showing a lens generated either from an ellipsoid or other aspherical surface having a similarly decreasing radius of curvature outwardly from a center point or points.
Figure 6B:
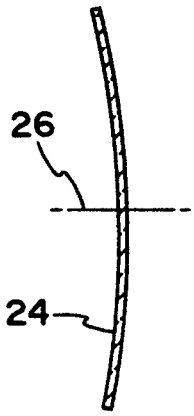

FIGS. 6A and 6B, similar to FIGS. 4A and 4B, show a lens 24 generated from an ellipsoidal surface; such a lens also assists in reducing the pincushion distortion phenomenon. These views also illustrate that the lens 24 could alternatively be generated as an aspherical surface of specified, incrementally decreasing radii, beginning from a center axis 26 or central point or points, the latter of which is illustrated in dotted lines in FIG. 6A. In any event, pincushion distortion is reduced in lenses 20 and 24 because the angles of incidence of incoming light rays, particularly from the direction of the more peripheral areas of the faceplate lens, are closer to being at right angles to tangents drawn at the lens surface than is the case with single-radius spherical lenses and conventional flat faceplate lenses of any readily available diving mask. Also, the outer areas of reduced radius provide a further reduced image size in those areas which effect appears to also contribute in reducing pincushion distortion.

Figure 8:
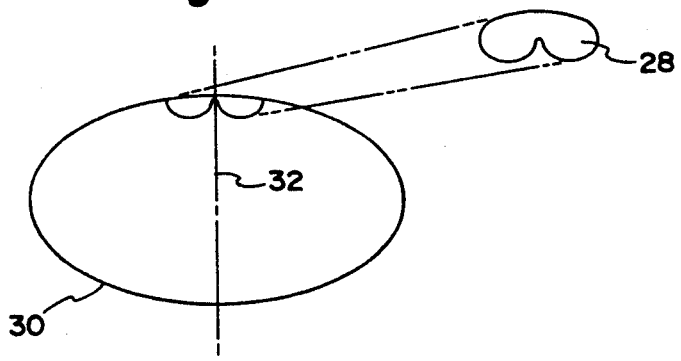
FIGS. 8, 9 and 10 are perspective, diagrammatic views showing generation of a faceplate lens from a short axis ellipsoid, long axis ellipsoid and paraboloid, respectively.
Figure 9:
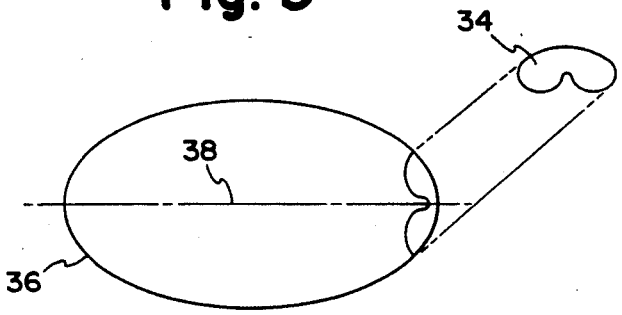
Figure 10:
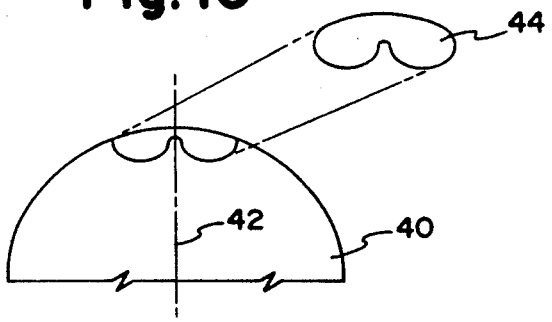

Turning now to FIGS. 8, 9 and 10, faceplate lenses generated from other geometric forms are illustrated. FIG. 8 illustrates a lens 28 generated from the surface of an ellipsoid 30 created by rotating an ellipse about its short axis 32. Here, it should be noted that the lens may be taken radially from the axial portion of ellipsoid 30 so that curvature of the lens away from its center axis (e.g., 32, FIG. 8) is uniform In FIG. 9 a lens 34 is generated from the surface of an ellipsoid 36 created by rotating an ellipse about its long axis 38. In this case, the lens may be taken radially from the long rather than short axial portion of ellipsoid 36 as is roughly illustrated.

In FIG. 10, the surface is a paraboloid 40 created by rotating a parabola about is axial centerline 42 and the lens 44 may be taken from the axial portion of paraboloid 40 as is roughly illustrated.

Figure 7:
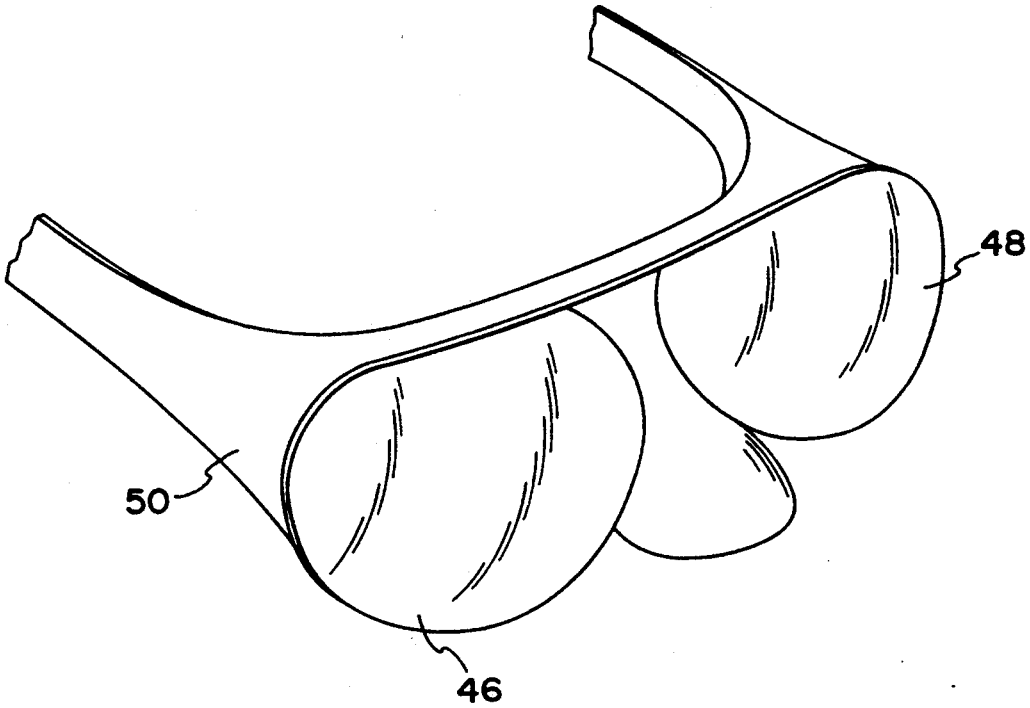
FIG. 7 is a perspective view of another embodiment of the invention.

FIG. 7 illustrates another embodiment of the invention comprising a pair of faceplate lenses 46, 48 mounted in a mask skirt 50. Preferably, lenses 46 and 48 are generated from a continuous smooth curved surface as in the embodiments discussed above. For example, if generated by a spherical surface, lenses 46 and 48 will have the same radius of curvature and common center of curvature, somewhat behind the eyes of the user. If desired, lenses 46 and 48 could be displaced somewhat from a true imaginary common spherical surface so as to provide two distinct centers of curvature, one for each lens, but each well behind the eyes of the wearer.

Figure 11:
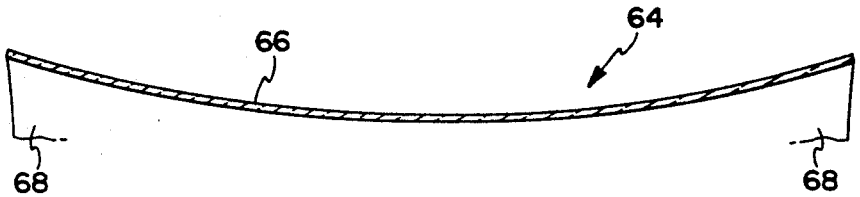
FIG. 11 is a largely diagrammatic view of a magnifying diving mask with a specified aspherical surface where radius of curvature generally increases towards the edges, for example, paraboloid-type.

A magnifying diving mask 64 is illustrated in FIG. 11, including a faceplate lens 66 in a frame 68, which lens may be selected from any of the lenses of the previously described embodiments except spherical, but is mounted in reverse, so that the convex surface of lens 66 is adjacent the user's face, rather than the concave side as in the previous embodiments. Distortion can be eliminated or mitigated in this type of mask by selecting a lens which possesses multiple radii of curvature where the radii lengths generally increase with increasing distance away from a central point or points, as in a paraboloid, for instance.

In all of the embodiments discussed, preferably the lens material is of uniform thickness but in certain applications it may be desirable to vary the material thickness and/or composition Also, it is desired that the lens structure be rather rigid so that predetermined visual properties of any selected lens are not varied or altered by bending, e.g., when a mask is placed on the face of the user.

While the present invention has been shown and described as applied to a diving mask, it is to be understood that it may also be incorporated in a diving helmet, a full face diving mask, or other underwater vision device.

While this invention has been described as having a preferred design, it is understood that it is capable of further modifications, uses and/or adaptations of the invention and following in general the principles of the invention and including such departure from the present disclosure as come within known or customary practice in the art to which the present invention pertains, and as may be applied to central features herein before set forth, and fall within the scope of the invention or the limits of the claims appended hereto.

I claim:

1. An underwater vision device comprising:

a) a supporting member arranged for sealing engagement with the face of the user; and b) a lens means mounted in said supporting member, said lens means being curved, a portion thereof being formed from a surface created by rotating an ellipse about one of its axes.

2. The underwater vision device of claim 1, wherein:

a) a portion of said lens means is generated from a surface created by rotating an ellipse about its long axis.

3. The underwater vision device of claim 1, wherein:

a) a portion of said lens means is generated from a surface created by rotating an ellipse about its short axis.

4. The underwater vision device of claim 1, wherein:

a) predetermined portions of said lens means are further curved to effect substantially distortion-free underwater vision.

5. The underwater vision device of claim 1, wherein:

a) said lens means is divided vertically, resulting in said underwater vision device having plural lens portions.

6. An underwater vision device comprising:

a) a supporting member arranged for sealing engagement with the face of the user; and b) lens means which is generally curved in a predetermined manner, a portion of which is made from a quantity of material generated from a surface created by rotating a parabola about its axis.

7. The underwater vision device of claim 6, wherein:

a) predetermined portions of said lens means are further curved to effect substantially distortion-free underwater vision.

8. The underwater vision device of claim 6, wherein:

a) said lens means is divided vertically, resulting in said underwater vision device having two lens portions.

9. An underwater vision device comprising:

a) a supporting member arranged for sealing engagement with the face of the user; and b) lens means mounted in said supporting member;

c) said lens means being generally curved in a predetermined manner, a portion of which is made from a quantity of material generated as an aspherical surface of incrementally decreasing radii beginning from a predetermined central point.

10. The underwater vision device of claim 9, wherein:

a) the incrementally decreasing radii begin from predetermined central points.

11. The underwater vision device of claim 10, wherein:

a) the side peripheral portions of said lens means are curved substantially differentially as compared to the upper and lower portions thereof.

12. The underwater vision device of claim 10, wherein:

a) predetermined portions of said lens means are further curved with a radius of curvature less than that of the central portion of the lens, to effect substantially distortion-free underwater vision.

13. The underwater vision device of claim 12, wherein:

a) said predetermined portions of said lens means are aspherical in configuration.

14. The underwater vision device of claim 10, wherein:

a) the side peripheral portions of said lens means are curved substantially differently as compared to the upper and lower portions thereof.

15. The underwater vision device of claim 9, wherein:

a) predetermined portions of said lens means are further curved, with a radius of curvature less than that of the central portion of the lens means, to effect substantially distortion free underwater vision.

16. The underwater vision device of claim 13, wherein:

a) said predetermined portions of said lens means are aspherical in configuration.

17. The underwater vision device of claim 9, wherein:

a) the side peripheral portions of said lens means are curved substantially differently as compared to the upper and lower portions thereof.

18. An underwater vision device, comprising:

a) a supporting member arranged for sealing engagement with the face of the user, and b) a lens means mounted in said supporting member;

c) a central portion of said lens means being spherical and having a single radius of curvature for a substantial portion thereof, whereby the apparent magnification of images underwater is less than that observed through a conventional lens plate;

d) predetermined portions of said lens means being further curved with a radius of curvature less than that of the central portion of said lens means to provide lens means portions of aspherical configuration.

19. The underwater vision device of claim 18, wherein:

a) said predetermined portions of said lens means are aspherical in configuration.

20. An underwater vision device, comprising:

a) a supporting member arranged for sealing engagement with the face of the user; and b) a lens means mounted in said supporting member;

c) said lens means being generally curved so that multiple radii of curvature are incorporated on the same optical surface of the lens means in such a predetermined manner that radius of curvature decreases progressively with increasing distance away from a predetermined central point on the lens means surface.

21. The underwater vision device of claim 20, wherein:

a) said lens means is divided vertically, to provide lens portions.

22. The underwater vision device of claim 20, wherein:

a) said lens means is generally curved so that multiple radii of curvature are incorporated on the same optical surface of the lens means in such a predetermined manner that radius of curvature decreases progressively with increasing distance away from predetermined central points on the lens means surface.

23. The underwater vision device of claim 22, wherein:

a) said lens means is divided vertically to provide lens portions.

24. An underwater vision device, comprising:

a) a supporting member for sealing engagement with the face of the user; and b) a lens means mounted in said supporting member;

c) said lens means being inverted with its convex side facing towards the eyes of the user to effect a magnified underwater image;

d) said lens means being generally curved so that multiple radii of curvature are incorporated on the same optical surface of the lens means i such a predetermined manner that radius of curvature increases progressively with increasing distance away from a predetermined central point on the lens means surface.

25. The underwater vision device of claim 24, wherein:

a) said lens means being generally curved so that multiple radii of curvature are incorporated on the same optical surface of the lens means in such a predetermined manner that the radius of curvature increases progressively with increasing distance away from predetermined points on the lens means surface.

26. The underwater vision device of claim 24, wherein:

a) said lens means is divided vertically, to provide lens portions.

27. A diving mask comprising:

a) a supporting member arranged for sealing engagement with the face of the user, and b) a lens means mounted in said supporting member, said supporting member being dimensioned so that the lens means is positioned near the eyes of the user with a portion of the nose extending forwardly of the lens means to provide a low profile, low internal volume mask;

c) a central portion of said lens means being substantially spherical in configuration and having a radius of curvature and a single center of curvature, whereby the apparent magnification of images underwater is less than that observed through a conventional lens plate;

d) a predetermined portion of said lens means being further curved with a radius of curvature less than that of said lens means to provide a lens mean portion of aspherical configuration to minimize optical distortions.

* * * * *